US007546648B2

(12) United States Patent
Steffes

(10) Patent No.: US 7,546,648 B2
(45) Date of Patent: Jun. 16, 2009

(54) STADIUM BED

(76) Inventor: Jason R. Steffes, 8513 Ruggles Rd., Baroda, MI (US) 49101

( * ) Notice: Subject to any disclaimer, the term of this patent is extended or adjusted under 35 U.S.C. 154(b) by 0 days.

(21) Appl. No.: 12/056,350

(22) Filed: Mar. 27, 2008

(65) Prior Publication Data

US 2008/0235869 A1 Oct. 2, 2008

Related U.S. Application Data

(60) Provisional application No. 60/909,059, filed on Mar. 30, 2007.

(51) Int. Cl.
*A47C 19/00* (2006.01)
*A47D 7/00* (2006.01)

(52) U.S. Cl. ..... 5/400; 5/201; 5/285; 5/286; 5/907

(58) Field of Classification Search ..... 5/400–402, 5/201, 286, 285, 907, 917, 93.1, 2.1; D6/388, D6/506

See application file for complete search history.

(56) References Cited

U.S. PATENT DOCUMENTS

| | | | | | |
|---|---|---|---|---|---|
| 4,091,746 | A | | 5/1978 | Kimbrough | |
| 4,103,375 | A | * | 8/1978 | Santo | 5/675 |
| D252,598 | S | * | 8/1979 | Carter | D6/388 |
| 4,492,409 | A | | 1/1985 | Laird | |
| 4,734,946 | A | * | 4/1988 | Saputo | 5/400 |
| 4,765,006 | A | * | 8/1988 | Jackson et al. | 5/658 |
| 4,888,837 | A | * | 12/1989 | Wang | 5/93.1 |
| 4,998,310 | A | * | 3/1991 | Olson | 5/710 |
| 5,182,824 | A | * | 2/1993 | Cipriano | 5/2.1 |
| 5,184,360 | A | * | 2/1993 | Gonzalez | 5/2.1 |
| D471,375 | S | | 3/2003 | Nichols, III et al. | |
| 6,578,214 | B2 | * | 6/2003 | Peftoulidis | 5/308 |

* cited by examiner

*Primary Examiner*—Alexander Grosz
(74) *Attorney, Agent, or Firm*—Price, Heneveld, Cooper, DeWitt & Litton LLP

(57) ABSTRACT

A bed, such as for a child, includes a plurality of block components releasably interconnected to form a ring with an open area therein large enough for a person to sleep in, the block components including inner and outer surfaces simulating a stadium for a professional sport such as football, baseball, soccer, rugby, hockey, or the like. Accessories such as goal posts, lights, a score board, and box office seating can be attached to the block components, and also additional accessories such as pillows, rugs, mats, mattresses, and the like can be positioned in and around the bed.

8 Claims, 4 Drawing Sheets

STADIUM BED

CROSS REFERENCE TO RELATED APPLICATION

This application claims benefit under 35 U.S.C. § 119(e) of provisional application Ser. No. 60/909,059, filed Mar. 30, 2007, entitled STADIUM BED, the entire contents of which are incorporated herein.

BACKGROUND

The present invention relates to furniture, and more particularly relates to a bed system constructed for ease of assembly and for appearance, including accessories for supplementing a theme appearance.

Modern consumers often decorate a children's bedroom with a theme. This may include incorporating the theme into furniture. However, "theme" furniture is often expensive, both due to its low volume and also due to the way that it is inefficiently packaged for transport. Also, "theme" furniture can be difficult to assemble. Also, where younger children are involved, safety is a major consideration.

SUMMARY OF THE PRESENT INVENTION

In one aspect of the present invention, a bed includes a plurality of block components each with inner and outer surfaces and with releasable edge connectors connecting adjacent ones of the components. The components, when arranged and interconnected, define a ring with sides and ends and an access area, the ring defining an open area therein large enough for a person to sleep.

In another aspect of the present invention, a child's bed includes a plurality of block components interconnected to form a ring with an open area therein large enough for a child to sleep in, the block components including an outer surface simulating a stadium for a professional sport such as football, baseball, soccer, rugby, hockey, and the like.

In yet another aspect of the present invention, a method of assembling a bed comprises steps of providing a plurality of block components with releasable connectors, and interconnecting the block components to form a ring with an open area therein large enough for a person to sleep in.

An object of the present invention is to provide furniture that is reasonably priced, easily packaged for transport, easy to assemble, and yet provides a dramatic theme-related look.

An object of the present invention is to provide safe furniture, particularly where younger children are involved.

These and other aspects, objects, and features of the present invention will be understood and appreciated by those skilled in the art upon studying the following specification, claims, and appended drawings.

DETAILED DESCRIPTION OF PREFERRED EMBODIMENTS

Figure 1:
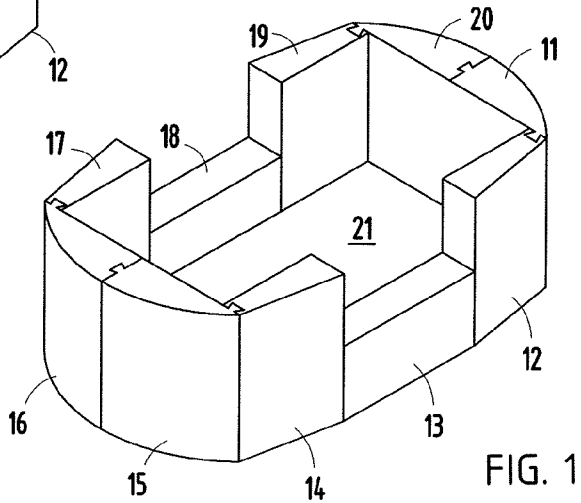
FIG. 1 is a perspective view of the present children's bed.
Figure 3:
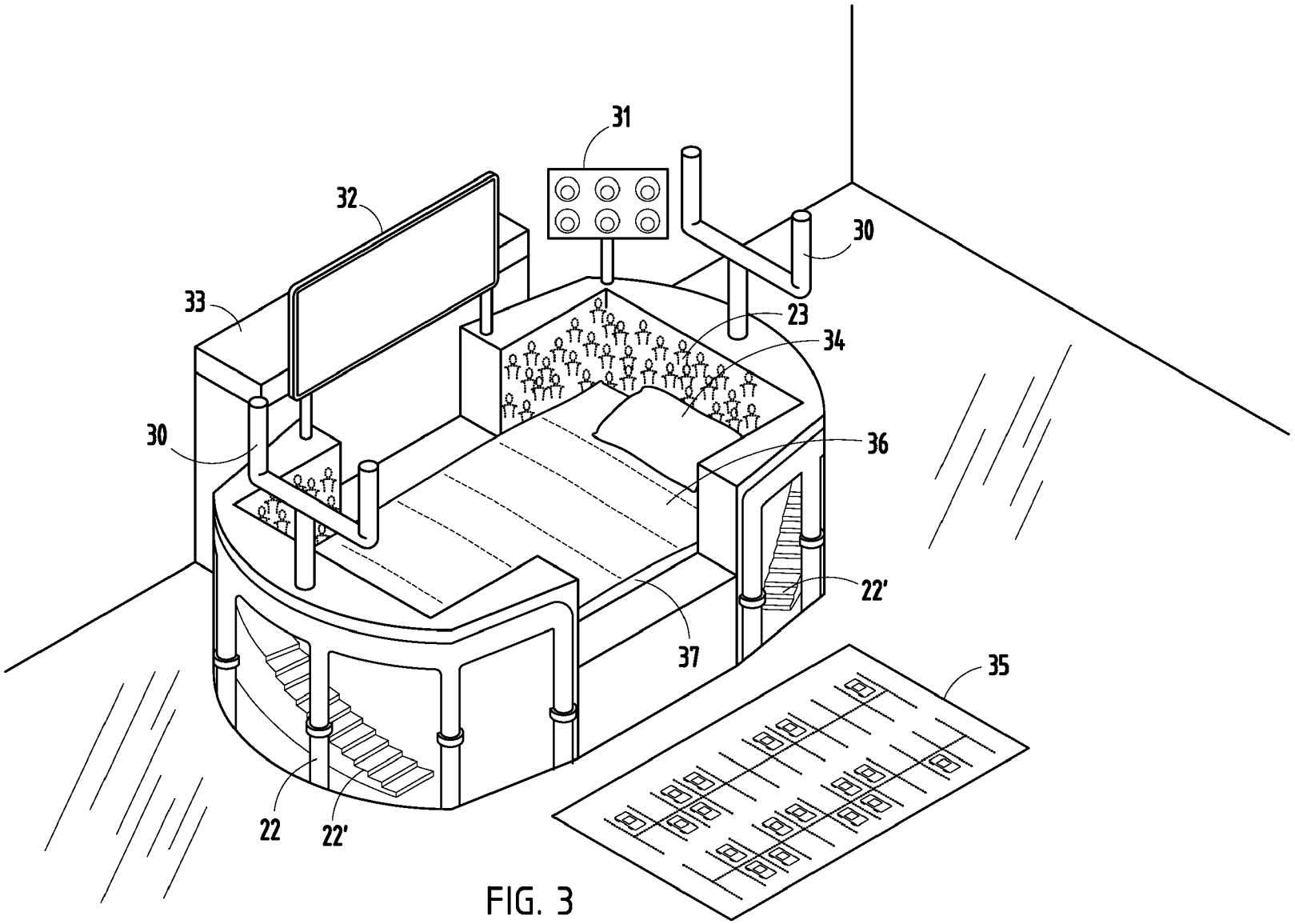
FIG. 3 is perspective view of a modified children's bed including accessories, and where the inner and outer surfaces of the bed are shaped to simulate a football stadium, the accessories including some attached to the block components and others positioned adjacent and associated with the bed.

A child bed 10 (FIG. 1) includes a plurality of block components 11-20 releasably interconnected to form a ring with an open area (shown as a rectangular area on the pattern 21 of FIG. 1) therein large enough for a child to sleep in. The illustrated block components 11-20 are blow-molded polymeric components, but it is contemplated that they can be formed by other molded processes (such as by extrusion or injection molding), and that they can be formed of other materials (such as foam, composite, wood product, etc.). Each of the illustrated block components 11-20 includes inner and outer surfaces simulating a stadium for a professional sport such as football, baseball, soccer, rugby, hockey, or the like. For example, the outer surface can include pillars 22 (FIG. 3), simulated stairs and ramps 22', and concession stands, and the inner surface can include structures or stickers 23 simulating stadium seating. It is contemplated that each of these features can be integrally formed as part of the blocks, or can be formed as separately attached items.

Figure 4:
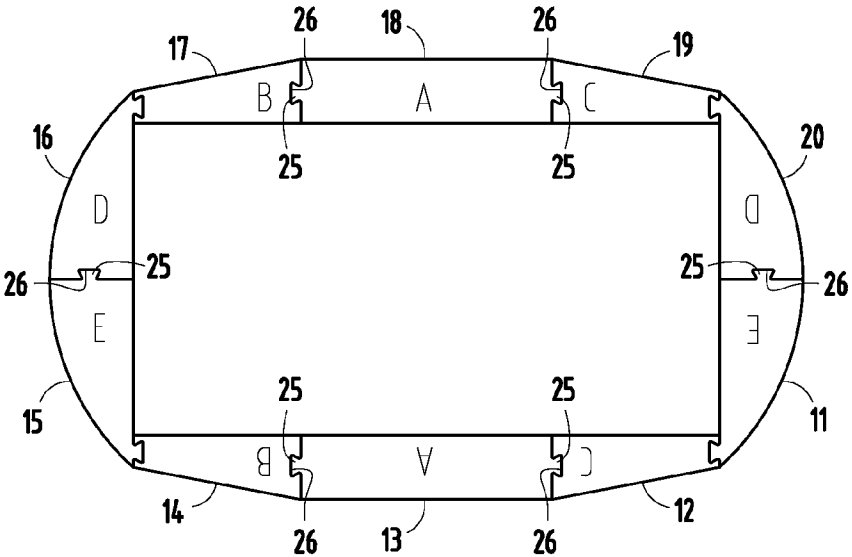
FIG. 4 is a top view of FIG. 1 including the tongue and groove connectors.

The illustrated connectors (FIGS. 4, 6-7) include mating dovetail tongues 25 and grooves 26 that interconnect by a vertical sliding motion. Their interconnection is easy, very quick, and intuitive to make, thus simplifying assembly considerably. It is contemplated that the connectors will interconnect with sufficient friction and positive interconnection to not require separate fasteners or secondary fastening. Nonetheless, it is contemplated that screws, tape, hook-and-loop, or other connecting means can be provided. It is also contemplated that the tongue-and-groove connections can be made to provide increased friction at the point of full assembly. It is also contemplated that other shapes can be used for the connectors in place of dove-tail-shaped connections, such as L-shaped, T-shaped, and other headed ridges or protrusions for engaging similarly-shaped mating grooves. Also, the illustrated connectors extend from top to bottom of the block components, but it is contemplated that the connectors need only extend part of a height of the block components and that one or more connectors can be formed (e.g. one above the other at spaced locations).

When assembled, the illustrated furniture preferably defines a ring having a complete perimeter, though it is contemplated that a scope of the present invention also includes furniture forming only a portion of a ring. One or more components, such as the illustrated side components 13 and 18, have a reduced height to provide easy access for a child. It is contemplated that a gate (either swing-out gate that is pivoted on one side and latched on another side . . . or a liftable/removable gate) could be added above the side components to provide a full-height ring completely around the child, not unlike a baby crib where the child is more retained in the open space within the bed. Where the gate is a removable partial-height gate, the gate can be a block component having a height sufficient to match a top of other block components when the gate component is assembled to the bed, such that the entire perimeter of the bed is substantially at a constant height.

Figure 2:
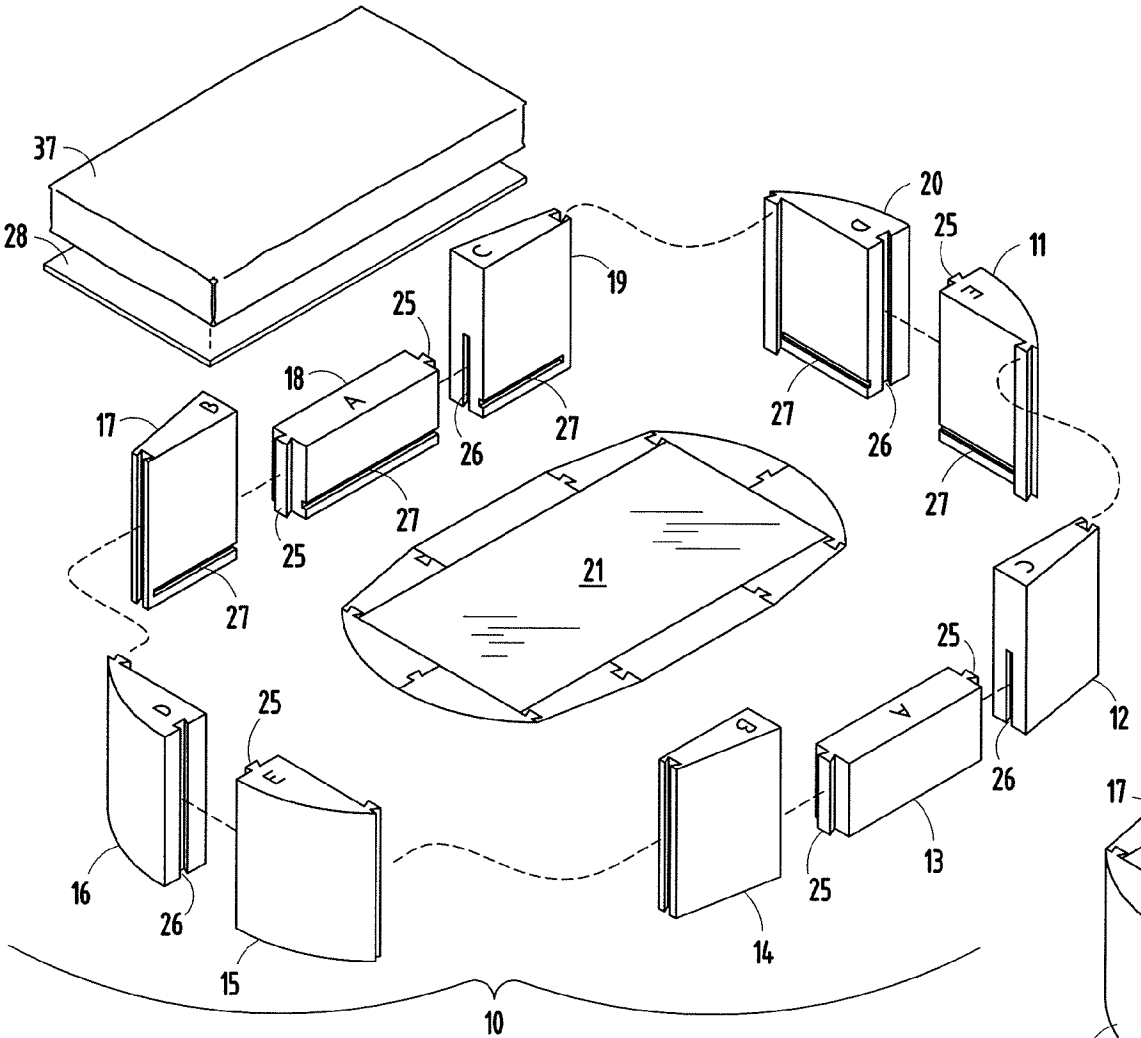
FIG. 2 is an exploded view of FIG. 1.

In one version, an inwardly-open slot (for example, see slot 27, FIG. 2) is formed along a lower portion of the block components, so that a plywood panel 28 (or bed spring frame or the like) can be slid horizontally into the slot in a manner that interlocks the components 11-20 against vertical disconnection. During assembly, at least one of the end components 15-16 in this version would be assembled last and would have to be configured to permit vertical connection without interference from the plywood panel 28. It is contemplated that this can be accomplished using screw-attached brackets or by using snap-lock fingers on the end components 15-16 or by providing a bottom groove on the end component that is downwardly open (thus permitting assembly of the one end component). Where snap-lock fingers are used, they would be designed to flex during vertical assembly to allow sliding downward movement past the plywood panel 28, and then would snap into a locking position as the end components 15-16 approached a final assembled position.

Accessories (FIG. 3) such as goal posts 30, lights 31, a score board 32, and box office seating 33 can be attached to the block components, such as into holes or other attachment structures on top of the block components. Also, additional accessories can be provided, such as pillows 34, parking-lot-simulating rugs 35, lined-field-simulating mats and blankets 36, lined mattresses 37 (FIG. 2), and the like for positioning in and around the bed.

Figure 5:
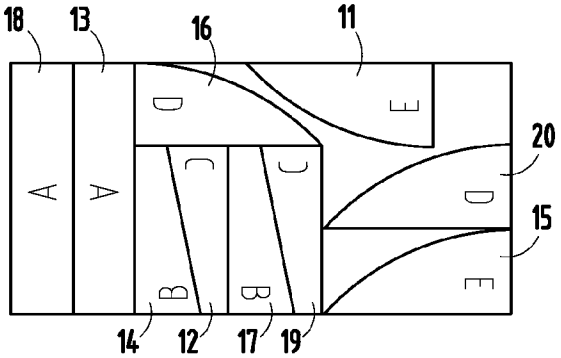
FIG. 5 is a top view showing the components of FIG. 1 arranged in a dense arrangement for shipping.
Figure 7:
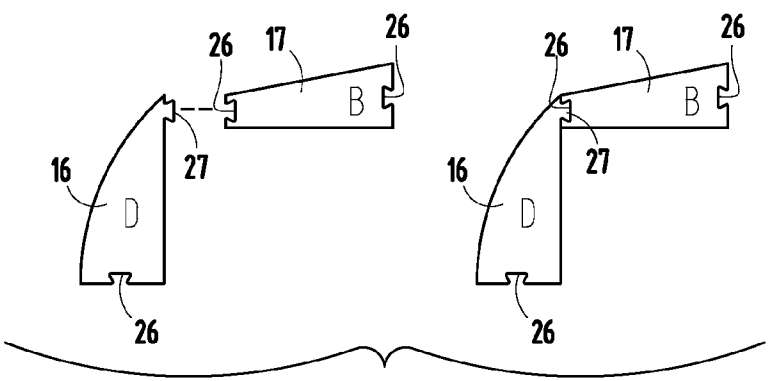
FIGS. 6-7 are top views showing assembly of side and corners, respectively, of FIG. 1.
Figure 6:
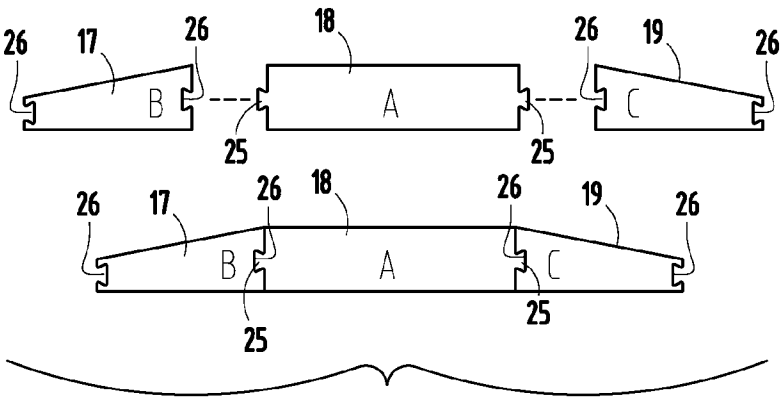
Figure 8:
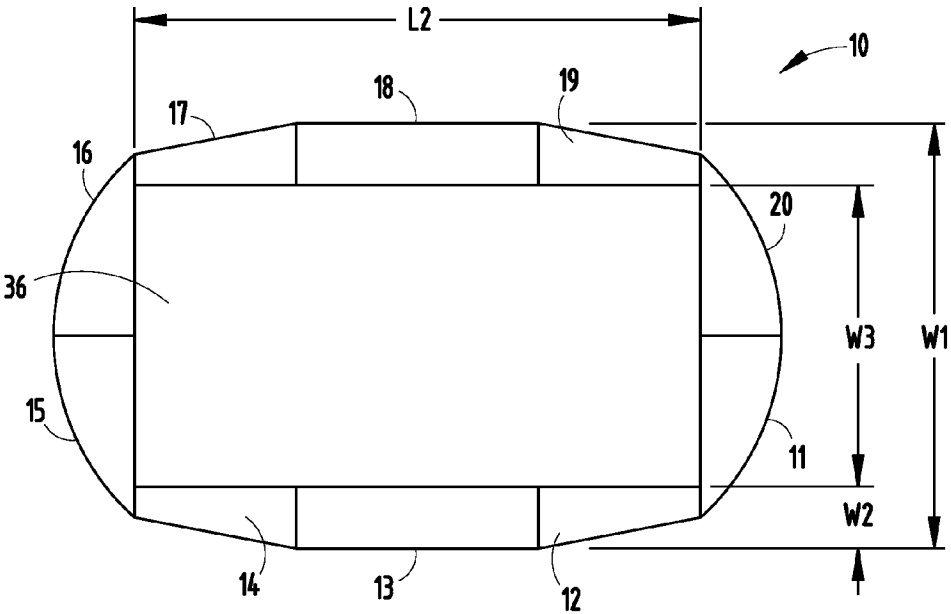

FIG. 5 shows one dense packaging arrangement, which is particularly advantageous due to its small package size (which allows for easy pickup and shipping by customers) and few components densely positioned for shipping (which lowers shipping costs). The illustrated package in FIG. 5 has a total long dimension of about 5 feet 4 inches and total short dimension of about 2 feet 8 inches, using the components noted below. FIGS. 6-7 show particular joints for assembly. Notably, FIG. 8 shows each of the end components as an assembly of components, but it is contemplated that the four components 14, 15, 16, and 17 can be made as a single component. In fact, it is contemplated that any two or more of the illustrated block components can be combined into a single block, or that the existing block components can be broken into two or more sub-components.

Figure 9:
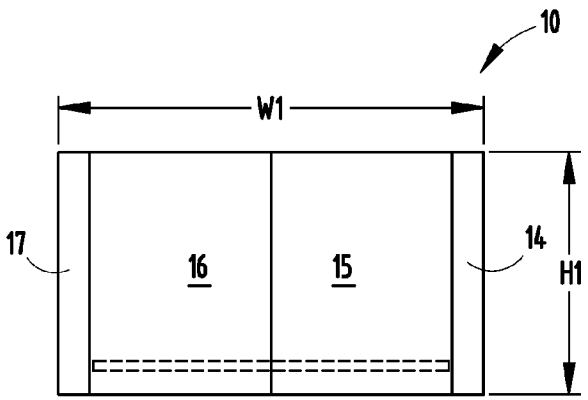
FIGS. 8-10 are top, end, and side views of FIG. 1 including preferred dimensions.
Figure 10:
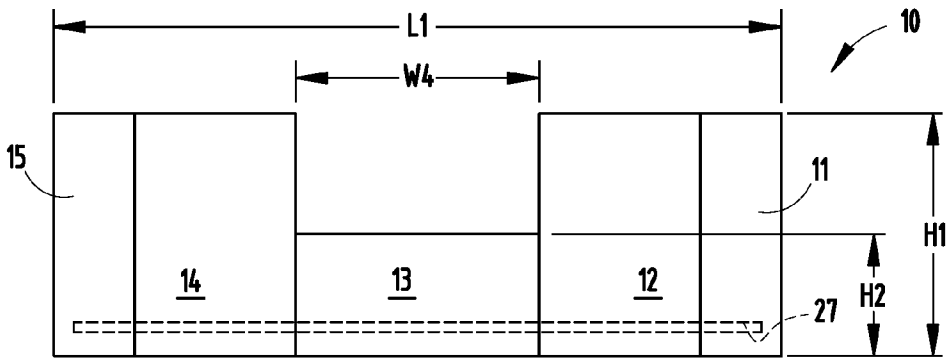

FIGS. 8-10 show one preferred dimensional shape and size for the various block components 11-20. In FIG. 8, a total length L1 of the bed is about 8 feet, a total width W1 is about 4 feet 8 inches, a thickest inside-to-outside width W2 of side block components is about 8 inches, and a thickest inside-to-outside width W3 of end block components is about 10 inches. In FIG. 10, a height H1 of the highest block components is about 2 feet 8 inches, and a height H2 of the lower block components is about 1 foot 4 inches, with a width W4 of the lower block components being just short of 2 feet 8 inches. However, it will be understood by persons skilled in this art that differently shaped blocks can be made to replicate different stadiums.

It is contemplated that different stickers can be made and used, and different attachable components/accessories can be provided, such that a wide and diverse number of different stadiums can be simulated with relatively low manufacturing, inventory, and distribution/shipping costs. Also, it is contemplated that universal block components could be made, and also that different panels (such as plastic sheets/panels for replicating particular stadiums) could be attached to the outer (or inner) surfaces of the block components for the purpose of providing different final appearances on inner and/or outer surfaces of the universal block component(s).

It is to be understood that variations and modifications can be made on the aforementioned structure without departing from the concepts of the present invention, and further it is to be understood that such concepts are intended to be covered by the following claims unless these claims by their language expressly state otherwise.

The embodiments of the invention in which an exclusive property or privilege is claimed are defined as follows:

1. A bed comprising:

a plurality of block components each with inner and outer surfaces and with releasable tongue-and-groove edge connectors connecting to adjacent ones of the components; the components, when arranged and interconnected, defining a ring with sides and ends and an access area, the ring defining an open area therein large enough for a person to sleep; at least some of the components including a horizontal slot along a lower portion, and including a panel that slidably engages the components and both interlocks the components against disconnection in a vertical direction and also serves as a mattress support; and wherein at least one of the block components has a height lower than others of the block components, the one block component providing an access into the open area.

2. The bed defined in claim 1, wherein the mating tongue-and-groove connectors define dove-tail-shaped connections.

3. The bed defined in claim 1, wherein some of block components include an upper surface with accessory connectors shaped to receive mating connectors on accessories that extend from the some block components.

4. The bed defined in claim 1, including accessories consisting of at least one of goal post, score board, stadium-simulating lights, and box-office-simulating stands.

5. The bed defined in claim 1, wherein at least some of the outer surfaces of the block components have surface shapes defining stadium-simulating features.

6. The bed defined in claim 5, wherein the block components include inner surfaces simulating bleachers on an interior of the stadium.

7. The bed defined in claim 1, including accessories consisting of at least one of pillows, rugs, mats, mattresses, lighting, and storage.

8. The bed defined in claim 1, wherein the block components form a complete ring.

* * * * *